US008050438B2

(12) United States Patent
Nikles et al.

(10) Patent No.: US 8,050,438 B2
(45) Date of Patent: Nov. 1, 2011

(54) CLOSURE ELEMENT FOR HOUSING OPENINGS DURING A TUMBLING PROCESS

(75) Inventors: Peter Nikles, Erlangen (DE); Erika Radick, Nürnberg (DE); Benjamin Schmidt, Nürnberg (DE); Christian Schmitt, Grossenseebach (DE); Erwin Singer, Eckental (DE); Cornelia Wiedenbrüg, Spardorf (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 811 days.

(21) Appl. No.: 12/157,639

(22) Filed: Jun. 12, 2008

(65) Prior Publication Data

US 2008/0317270 A1 Dec. 25, 2008

(30) Foreign Application Priority Data

Jun. 20, 2007 (DE) ..... 10 2007 028 230

(51) Int. Cl.
*H04R 25/00* (2006.01)

(52) U.S. Cl. ..... 381/322; 381/312; 381/324; 381/328; 381/370; 381/380

(58) Field of Classification Search ..... 381/312, 381/322, 324, 328, 370, 380; 181/129, 130, 181/135; 264/39, 341; 29/896.2, 896.21
See application file for complete search history.

(56) References Cited

U.S. PATENT DOCUMENTS

| | | | | |
|---|---|---|---|---|
| 4,834,927 | A * | 5/1989 | Birkholz et al. | 264/134 |
| 7,050,876 | B1 * | 5/2006 | Fu et al. | 700/118 |
| 7,113,611 | B2 * | 9/2006 | Leedom et al. | 381/322 |
| 2006/0239481 | A1 * | 10/2006 | Martin | 381/312 |

FOREIGN PATENT DOCUMENTS

DE 102005013834 A1 9/2006

* cited by examiner

*Primary Examiner* — Davetta W Goins
*Assistant Examiner* — Matthew Eason

(57) ABSTRACT

The manufacture of housing parts of a hearing apparatus and in particular a hearing device is to be simplified. To this end, provision is made to also efficiently use a so-called tumbling process for the surface treatment of housing. On account of this, a closure element is proposed for closing openings of housing parts for a hearing apparatus of this type during a tumbling process. The closure element has a disk-like center part, a first column section, which protrudes from the one side of the disk-like center part and has a first swelling on its free end, and a second column section, which protrudes from the other side of the disk-like center part and has a second swelling on its free end. A closure element of this type allows openings of housing parts, which are attached to the column sections, to be closed and protected for a tumbling process.

13 Claims, 1 Drawing Sheet

CLOSURE ELEMENT FOR HOUSING OPENINGS DURING A TUMBLING PROCESS

CROSS REFERENCE TO RELATED APPLICATIONS

This application claims priority of German application No. 10 2007 028 230.5 filed Jun. 20, 2007, which is incorporated by reference herein in its entirety.

FIELD OF THE INVENTION

The present invention relates to a closure element for closing openings of housing parts for a hearing apparatus during a tumbling process. Furthermore, the present invention relates to a corresponding method for producing housing parts of hearing apparatuses. The term hearing apparatus is understood here to mean in particular devices that can be worn on the ear, like for instance hearing devices, headsets, earphones and the like.

BACKGROUND OF THE INVENTION

Hearing devices are wearable hearing apparatuses which are used to assist the hard-of-hearing. In order to accommodate numerous individual requirements, various types of hearing devices are available such as behind-the-ear (BTE) hearing devices and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

An ITE hearing device adjusted to a user generally consists of a lower part (shell) and an upper part (face plate and/or casing). After assembling the shell and/or casing with corresponding hearing device components, the casing and/or the upper part is adhered to the shell. It is necessary for both parts to rest closely against one another so that no foreign objects can enter the hearing device.

Hearing device shells, but also casings, are frequently produced using stereolithography methods (SLA). However, after this production step, they have to be smoothed, i.e. grinded or polished, but also coated if necessary. These method steps can be implemented in a so-called tumbling machine. In this way, the entire surface of the work piece is treated. Surfaces and edges are thus also abraded, which is undesirable in these cases. However, following their manufacture, the openings for components, but also the openings to which the housing parts are added, are in particular no longer allowed to be damaged or destroyed.

DE 10 2005 013 834 A1 discloses a method for producing a hearing aid component and a corresponding hearing aid component in which a stereolithography method is used for production purposes.

According to internal sources, only the lower parts, i.e. the shells, are currently produced using stereolithography methods. Here the cutting edge, to which the shell with the casing is added, is reinforced with material, so that various polishing and smoothing methods can be carried out without any problem. In a subsequent manual work step, the surplus material must then be removed.

The upper part, namely the faceplate, is currently typically manufactured as an injection-molded plate. No tumbling process is needed here. After adhering the casing and/or the face plate to the shell, protruding parts of the casing must be cut off manually. This represents a very high outlay in respect of the production of a hearing device.

SUMMARY OF THE INVENTION

The object of the present invention thus consists in reducing the production outlay during the manufacture of a housing of a hearing apparatus.

This object is achieved in accordance with the invention by a closure element for closing the openings of housing parts for a hearing apparatus during a tumbling process, including:

a disk-like center part, a first column section, which protrudes from the one side of the disk-like center part and has a first swelling on its free end, and a second column section, which protrudes from the other side of the disk-like center part and has a second swelling on its free end.

Furthermore, provision is made in accordance with the invention for a method for smoothing or coating a first and a second housing part for a hearing apparatus in a tumbling process by providing an afore-described closure element, attaching the first housing part, which has a first and a second opening, to the closure element, so that the first swelling of the closure element closes the first opening and the center part with the one side closes the second opening, attaching the second housing part, which has a first and a second opening, to the closure element, so that the second swelling of the closure element closes the first opening and the center part with its other side closes the second opening, and inserting the assembled closure element into a tumbling machine.

The closure element with its disk-like center part advantageously closes the second opening, which is generally used to join to another housing part. The swelling on the first column section of the closure element closes another opening of the housing part, so that the interior of the housing and in particular the inner bracket and as yet non-continuous, preformed openings are not damaged by the tumbling granules.

One particular advantage of the closure element according to the invention nevertheless consists in it being possible to simultaneously fasten two housing parts thereto and for these to be protected by said fastening procedure during the tumbling process.

The closure element can be designed to be symmetrical in respect of the main plane of the disk-like center part. This means that identical column sections protrude outwards on both sides of the center part. Two casings or two shells of the same or similar design can thus be joined by the closure element for instance for the tumbling process.

The closure element preferably consists of a rubbery-elastic material. This material allows the housing parts to be held together under tension but still in an easily mountable and removable fashion.

The first column can comprise at least one additional swelling between the center part and the first swelling. The second column can also be configured in this way. These additional swellings allow housing parts of different depths and/or installation heights to be fastened to the closure element.

The closure element and/or method according to the invention is used particularly advantageously to manufacture the two shell halves of a hearing device housing, with the two shell halves representing the first and second housing part. This is logistically advantageous in that following the common manufacture of the two shell halves, these are also held together in a further method step. This clearly also saves on assignment work, since in this way the two shell halves do not have to be reassigned to one another following the tumbling process; this is often very laborious as a result of their similarity.

In particular, the two housing parts can be the two shell halves of an ITE hearing device housing, with the first column section being inserted through a module opening and the second column section being inserted through a sound output opening. In this way, the swellings on the column sections are adjusted to the sizes of the openings. The two housing parts can similarly also represent halves of a CIC hearing device housing.

BRIEF DESCRIPTION OF THE DRAWINGS

The present invention is described in more detail with reference to appended drawings, in which.

DETAILED DESCRIPTION OF THE INVENTION

Figure 1:
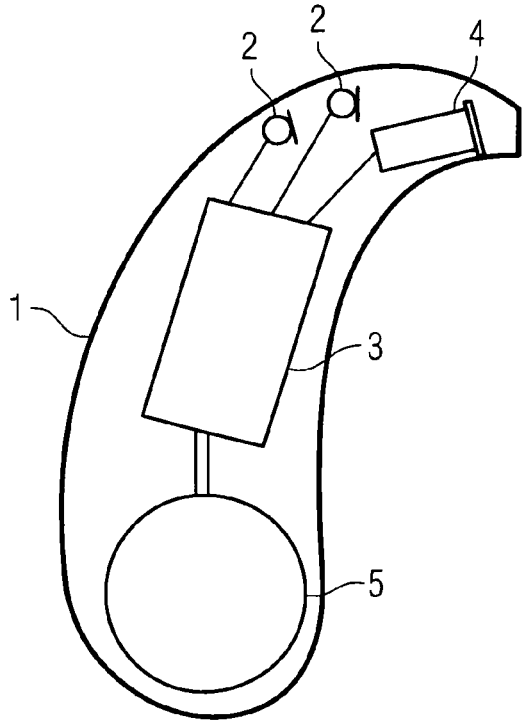
FIG 1 (Prior art)
FIG. 1 shows the basic design of a hearing device with its essential components as claimed in the prior art.

The exemplary embodiments illustrated below represent preferred embodiments of the present invention.

When producing an upper part and/or a casing 10 (cf. FIG. 2), only the module opening 11 (apart from the second opening 12 mentioned below) is to be continuous. This module opening allows an amplifier module, if necessary with battery and/or programming contacts, possibly of the battery axis, with receivers and microphones, to be inserted into the hearing device housing and to be removed therefrom. In a similar manner, the battery of the hearing device can be inserted and/or replaced through this opening. The remaining component openings on the casing 10 are closed from the outside with a defined material cover. They are drilled as appropriate following the tumbling process.

The casing 10 is finally attached to a shell and adhered thereto. To this end, the casing 10 opens downwards. In other words, it has an opening which is referred to in this document as the second opening 12.

To protect the edges of the second opening 12 and the module opening 11 during the tumbling process, the casing 10 is attached to a plug and/or a closure element 13. This closure element 13 consists of a rubbery-elastic material and has a disk-like center part 14. A first column 15 and/or a first column section 15, which has a swelling 16 on its free end, protrudes at right angles herefrom. The first or module opening 11 is thus closed by the first column section 15 and its swelling 16 and the second opening 12 of the casing 10 is closed by the center part 14. As a result, the interior of the casing 10 but also the edges of the two openings 11 and 12 are protected during the tumbling process.

A column section 17 with a swelling 18 at the end is likewise provided on the other side of the center part 14. A second casing 19 is attached to the second column section 17, the openings of which casing 19 are likewise closed and protected by the column section 17 itself and/or the swelling 18 and the center part 14.

Figure 2:
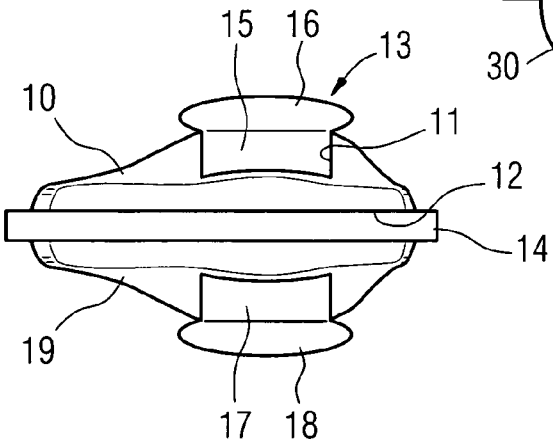
FIG. 2 shows a closure element according to the invention with an attached hearing device casing and FIG. 3 shows an inventive closure element of a further embodiment with an attached casing and an attached shell of hearing device housing.

In the example in FIG. 2, the closure element 13 is designed to be symmetrical and can receive two casings 10 and 19. This is advantageous particularly in the case of a binaural supply, since it is thus possible to process the casings 10, 19 of the left and right sides together.

Figure 3:
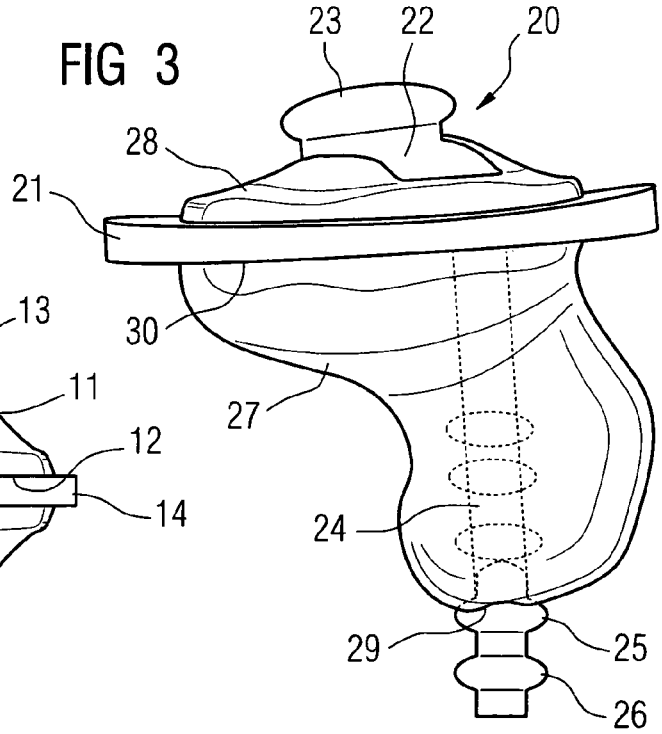

FIG. 3 shows a further embodiment of a closure element 20 according to the invention. The closure element 20 once again has a disk-like center part 21 and a first column section 22 with a swelling 23 at the end on one side. In this respect, the closure element 20 corresponds to the closure element 13 in FIG. 2. Another column section 24 is however molded here on the other side of the center part 21. It has several swellings 25, 26 at regular intervals. It also has a smaller diameter than column section 22. This second column section 24 is provided here to receive a hearing device shell 27 which is consistent with the casing 28 fastened on the other side of the closure element 20. In particular, the hearing device shell 27 with its receiver opening, i.e. the sound output opening 29, is attached to the column section 24. In this case, the second column section 24 with the swelling 25 closes and protects the sound output opening 29, while the second opening 30, to which the casing 28 is joined, is protected and closed by the center part 21. The swellings 23, 25 and 26 likewise ensure that neither the shell 27 nor the casing 28 slip away from the closure element 20. As a result of the elasticity of the closure element 20, both the shell 27 and also the casing 28 are additionally pressed against the relevant side of the center part 21.

This second embodiment of a closure element 20 is advantageous particularly for the common production of the upper and lower part of a hearing device. In this way, it is not only the module opening of the casing and the other opening thereof which is protected, but instead also the receiver opening 29. With the use of a closure element 20 of this type, reinforcement of the cutting edge between the shell 27 and casing 28 is not needed, thereby dispensing with the need for a subsequent manual removal of this reinforcement.

The invention claimed is:

1. A closure element for closing an opening of a housing part of a hearing aid during a tumbling process, comprising:

a center part;

a first column section that protrudes from one side of the center part and has a first swelling on a free end of the first column section for closing a first opening of a first housing part of a hearing aid; and a second column section that protrudes from the other side of the center part and has a second swelling on a free end of the second column section for closing a first opening of a second housing part of a hearing aid.

2. The closure element as claimed in claim 1, wherein the closure element is symmetrical in respect of a main plane of the center part.

3. The closure element as claimed in claim 1, wherein the closure element comprises a rubbery-elastic material.

4. The closure element as claimed in claim 1, wherein the second column section comprises an additional swelling between the center part and the second swelling.

5. The closure element as claimed in claim 1, wherein the center part is a disk-like center part.

6. A method for closing openings of housing parts of a hearing aid during a tumbling process, comprising:

a center part, a first column section that protrudes from one side of the center part and has a first swelling on a free end of the first column section, and a second column section that protrudes from the other side of the center part and has a second swelling on a free end of the second column section;

attaching a first housing part of the hearing aid to the closure element for closing a first opening of the first housing part by the first swelling of the closure element and for closing a second opening of the first housing part by the one side of the center part; and attaching a second housing part of the hearing apparatus to the closure element for closing a first opening of the second housing part by the second swelling of the closure element and for closing a second opening of the second housing part by the other side of the center part.

7. The method as claimed in claim 6, wherein the first housing part is a first shell half of a housing of the hearing aid and the second housing part is a second shell half of the housing of the hearing apparatus.

8. The method as claimed in claim 7, wherein the housing is a common housing.

9. The method as claimed in claim 6, wherein the first opening of the first housing part is a module opening.

10. The method as claimed in claim 9, wherein the first column section is inserted through the module opening.

11. The method as claimed in claim 6, wherein the first opening of the second housing part is a sound output opening.

12. The method as claimed in claim 11, wherein the second column section is inserted through the sound output opening.

13. The method as claimed in claim 6, wherein the hearing aid is an ITE hearing aid.

* * * * *